United States Patent [19]

Ruh

[11] 4,344,694

[45] Aug. 17, 1982

[54] DEVELOPING EQUIPMENT FOR AN ELECTROPHOTOGRAPHIC COPYING DEVICE

[75] Inventor: Gerhard Ruh, Wilhelmshaven, Fed. Rep. of Germany

[73] Assignee: Olympia Werke AG, Wilhelmshaven, Fed. Rep. of Germany

[21] Appl. No.: 173,200

[22] PCT Filed: Mar. 2, 1979

[86] PCT No.: PCT/DE79/00025

§ 371 Date: Nov. 2, 1979

§ 102(e) Date: Nov. 2, 1979

[87] PCT Pub. No.: WO79/00708

PCT Pub. Date: Sep. 20, 1979

[30] Foreign Application Priority Data

Mar. 4, 1978 [DE] Fed. Rep. of Germany ..... 2809353

[51] Int. Cl.[3] ..... G03G 15/00

[52] U.S. Cl. ..... 355/3 DD; 118/657; 118/661

[58] Field of Search ..... 355/3 R, 3 DD; 118/653, 118/656, 657, 658, 661

[56] References Cited

U.S. PATENT DOCUMENTS

| | | | |
|---|---|---|---|
| 3,402,698 | 9/1968 | Kojima et al. | 118/637 |
| 3,882,821 | 5/1975 | Katayama et al. | 355/3 DD X |
| 3,941,469 | 3/1976 | Okamoto | 355/3 DD |
| 4,018,187 | 4/1977 | Abbott et al. | 118/658 |
| 4,136,637 | 1/1979 | Snelling | 118/658 |

FOREIGN PATENT DOCUMENTS

| | | |
|---|---|---|
| 2010737 | 11/1970 | Fed. Rep. of Germany . |
| 1572348 | 8/1973 | Fed. Rep. of Germany . |
| 944654 | 12/1963 | United Kingdom . |

OTHER PUBLICATIONS

Zelazny, Joseph, "Flexible Roll Shell", Xerox Disclosure Journal, vol. 1, Nos. 9 and 10, Sep./Oct. 1976, p. 13.

Sanders, K., "Magnetic Brush Developer", IBM Technical Disclosure Bulletin, vol. 19, No. 4, Sep. 1976, pp. 1410 and 1411.

*Primary Examiner*—Fred L. Braun

*Attorney, Agent, or Firm*—Spencer & Kaye

[57] ABSTRACT

The developing apparatus for an electrophotographic copier has a developing drum which includes a fixedly arranged, nonmagnetic hollow cylinder and a magnetic arrangement rotatably mounted thereon. On the electrically conductive surface of the hollow cylinder there is disposed a magnetic brush of magnetic developer particles which are transferred by the magnetic brush onto an intermediate image carrier due to the electric field generated by the latent image. At its portion adjacent the intermediate image carrier, the hollow cylinder has a reduced wall thickness thus providing a larger brushing surface for the uniform production of the developer image.

4 Claims, 4 Drawing Figures

DEVELOPING EQUIPMENT FOR AN ELECTROPHOTOGRAPHIC COPYING DEVICE

STATE OF THE ART

Latent, electrostatic images are usually developed by means of developing apparatus equipped with so-called magnetic brushes. These devices include one or a plurality of magnetic rollers for transferring a magnetically attractable developer powder from a reservoir to the latent, electrostatic image. In order to obtain uniform development of the electrostatic image, it is necessary for the magnetic roller, which is used to transfer the developer powder to the image, to be covered with a uniform layer of powder at least in the area of the developing zone. However, such a uniform powder layer can be achieved only if a homogeneous magnetic field is present in the developing zone over the entire operating range of the magnetic roller. In particular, with high speed developing apparatus it is further necessary that a strong magnetic field be generated near the cylindrical surface of the magnetic roller to prevent the developer powder from being flung away at the high rotational speed of the cylinder. Moreover, the reaction time provided for development of the latent image has been steadily reduced as a result of the increased speed of movement of the image carrier.

One way to increase the speed is to increase the length of the developing zone. Such a device is disclosed in German Offenlegungsschrift No. 2,010,737 in which two directly adjacently arranged magnetic brush developing rollers are provided. By mutual interaction, the magnetic fields of these two magnetic brush developing rollers hold the developer substance in contact with the latent electrostatic image over an extended area. An enlargement of the effective developing zone is obtained thereby but requires additional expenditures and structures.

Additionally, German Offenlegungsschrift No. 1,572,348 discloses a developing apparatus in which the resulting brush has a rectangular cross section so that a sufficiently large contact or friction area is obtained with the surface of the photosensitive layer. This assures, at greater expense, that the toner or image powder, respectively, is deposited on the photosensitive layer in sufficient quantities and uniformly.

PROBLEM AND SOLUTION

It is the object of the invention to improve the development of latent electrostatic images with magnetizable developing substances and to attain, with the simplest means, an increase in the size of the developing zone, in order to be able to produce a high quality image. Furthermore, the magnetic rollers employed should have the lowest possible magnetic induction. This is accomplished by the present invention.

With the developing apparatus according to the invention, the brush surface of a given brush length is increased with simple means so that a uniform deposit of the developer particles is realized and an abrasive effect at the image surface is avoided.

DESCRIPTION OF THE PREFERRED EMBODIMENTS

Figure 1:
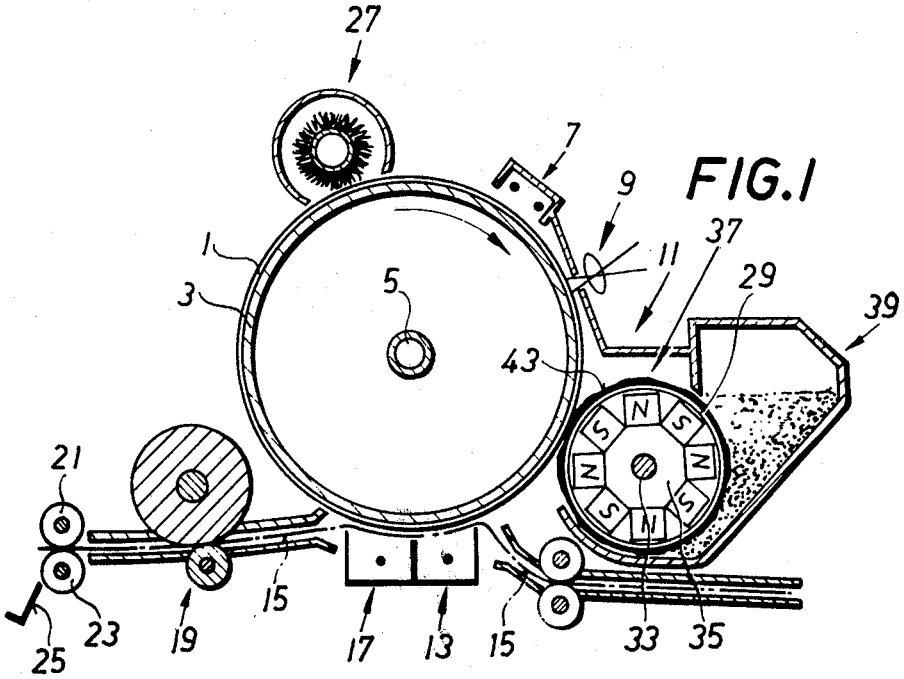
FIG. 1 is a schematic sectional view of the apparatus according to the invention.

FIG. 1 shows in a schematic sectional view parts of an electrophotographic copier in which a photoconductive sheet 1 is fixed on a guide drum 3. The guide drum 3 rotates on an axis 5 and is mounted in a frame (not shown) of the machine for movement past the individual processing stations. The photoconductive sheet is initially charged in a charging station 7, is then photographically exposed in an exposure station 9 and then developed in a developing station 11. Then the image existing on the photoconductive sheet 1 is transferred to a receiving material 15 in a transfer station 13. After the transfer, the record carrier material is removed from the photoconductive sheet 1 by means of a removing corona 17 and is brought to a pressure fixing station 19 from where the record carrier material 15 is then transported by means of transporting rollers 21, 23 into a depository 25. The toner particles still remaining on the photoconductive sheet 1 after the transfer are then removed from the photoconductive sheet 1 in a cleaning station 27. The above-mentioned processing stations are shown only schmetically and may of course also be of different design.

Figure 2:
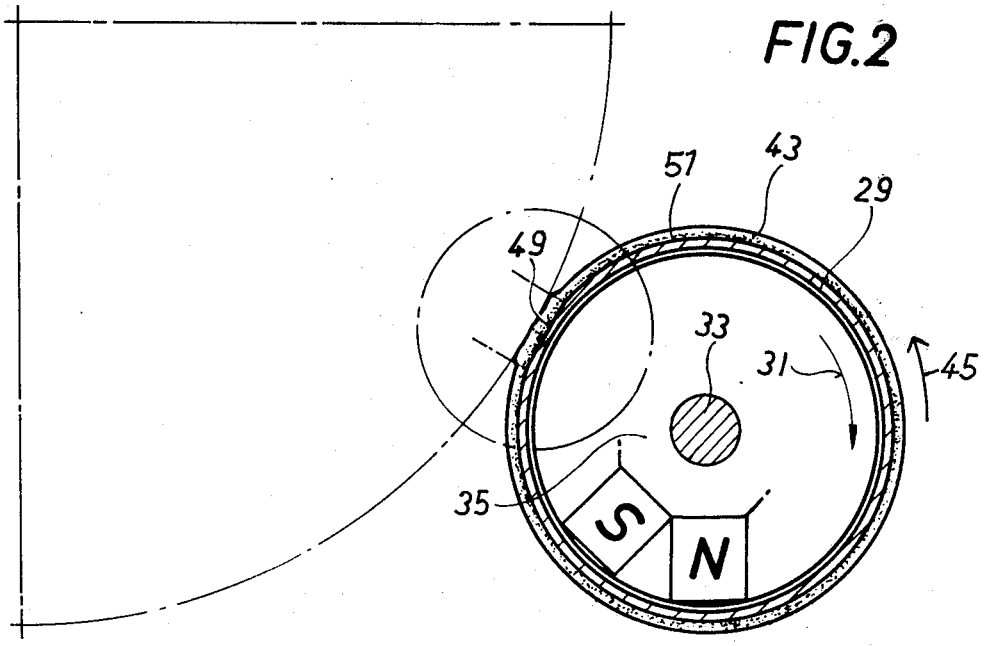
FIG. 2 shows a detail of FIG. 1.
Figure 3:
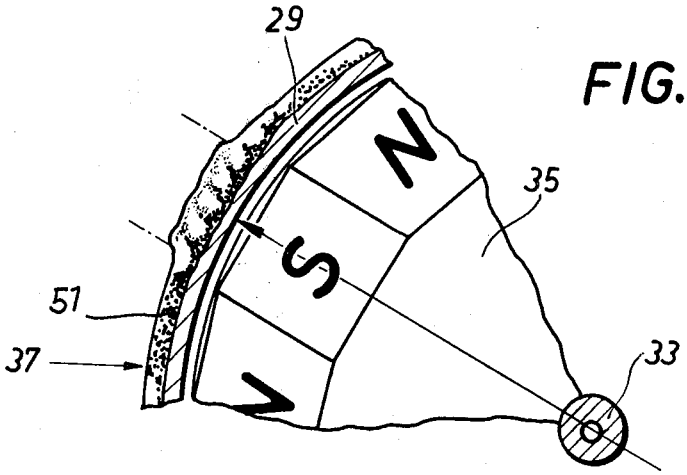
FIG. 3 is a detail of FIG. 2.

FIG. 2 is an enlarged illustration of the developing station. Here, a nonmagnetic hollow cylinder having an electrically conductive surface is fixed to the machine frame. Within this hollow cylinder 29 at a short distance therefrom a magnetic roller 35 is disposed which is mounted to be rotatable on an axis 33 in the direction of the arrow 31. The magnetic roller 35 is provided with a number of magnetic poles which are arranged in juxtaposition on its circumferential face. Above the magnetic roller 37 there is provided a funnel-shaped reservoir 39 for the magnetic developer particles.These developer particles may consist of toner particles which have a ferromagnetic material in powder form as their core. It is of course also possible within the scope of the invention for the developer particles to consist of a mixture of a toner and a carrier which may be iron particles or some other ferromagnetic material. As particularly shown in the embodiment of FIG. 4, the reservoir 39 has a funnel-shaped cross section and a slit-like opening 41 at its bottom through which the developer particles reach the magnetic roller 37. The rotating magnetic roller 35 generates a magnetic brush 43 on the outer circumferential face of the hollow cylinder 29. The magnetic brush 43 is moved in the direction of the arrow 45 opposite to the direction of rotation 31 of the magnetic roller 35. In order to obtain a brush layer of uniform height, a stripper 47 is fastened in the area of opening 41 so as to extend in the axial direction over the entire length of the magnetic roller 37. It is of course also possible within the scope of the invention from the edge of the stripper that comes into engagement with the magnetic brush 43 to have a serrated configuration.

In order to assure unimpaired action of the developer substance on the latent image to be developed, the wall thickness of the nonmagnetic hollow cylinder 29 is reduced at its portion adjacent the intermediate image carrier 1. This reduction in wall thickness is formed by a flattened portion 49 at the outer circumference 51 of the hollow cylinder 29 along the intermediate image carrier 1. This reinforces the magnetic field of the rotating magnetic roller 37 in the area of the developing zone and produces a planar distribution of the developer substance in the developing zone. Due to the greater density in the distribution of the lines of force in the developing zone, the magnetic brush is given a favorable, bushy shape so that perfect and reliable development of the latent electrostatic image on the intermediate image carrier 1 is always realized.

Figure 4:
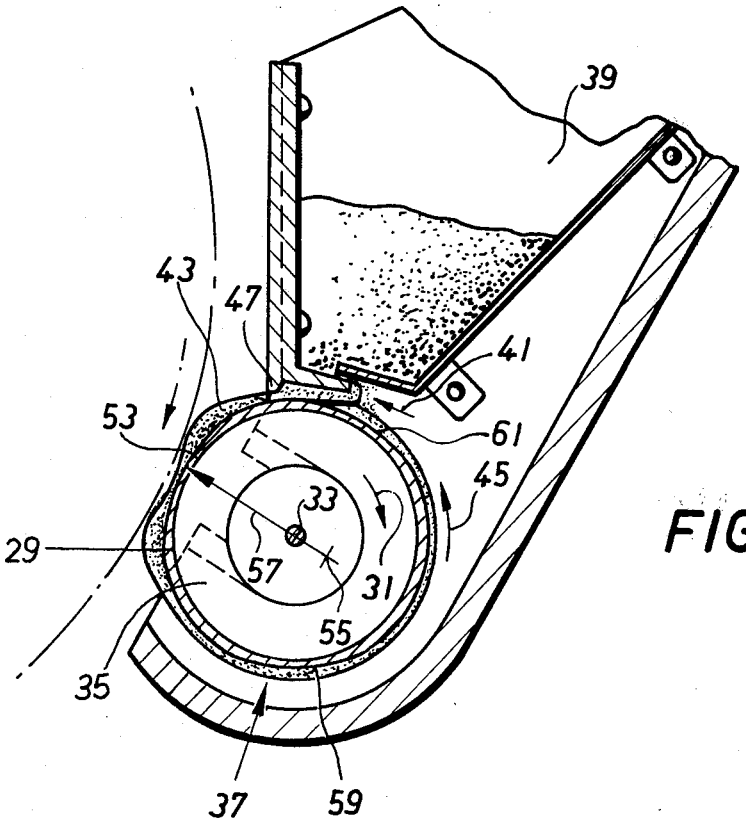
FIG. 4 illustrates a second embodiment of the magnetic roller.

In order to enhance the pushing action of the magnetic brush 43 on the outer circumference of the hollow cylinder 29, the flattened portion 49 may also be given a curvature 53 according to FIG. 4 whose center of curvature 55 lies on the normal 57 through the axis of rotation 33 of the rotating magnetic roller 35 on the side of the circumferential face of the hollow cylinder 29 facing the flattened portion 49. The points of transition between the curvature 53 and the outer circumference of the hollow cylinder are likewise rounded.

When there is a large covering of toner, the weight of the toner underneath the magnetic brush may produce a reinforcement of the toner covering such that the magnetic force will no longer be able to transport all of the toner. This causes a loss of toner which soils the machine or the magnetic brush, respectively, or even clogs them. In order to prevent this, the hollow cylinder 29 is provided with a further reduction in wall thickness, e.g. a flattened portion 59, along its underside. With the now greater influence of the magnetic force, loss of toner is avoided. Furthermore, according to FIG. 4, the hollow cylinder 29 may be provided with a further flattened portion 61 alongside the dosaging gap. This assures that sufficient developer substance will always be withdrawn from the reservoir 39 through the slit-like opening 41 and the height of the magnetic brush 43 will be uniform.

The apparatus according to the invention permits the rotating magnetic roller 35 to produce a stronger, uniform magnetic field in the developing zone so that a magnetic brush is generated which has a rectangular cross section. The enlarged contact or friction area of the magnetic brush on the surface of the intermediate image carrier 1 assures that the developer substance is deposited on the intermediate image carrier in sufficient quantity and uniformly.

Due to the fact that the rotating magnetic roller produces constant magnetic fields, the magnetic force acting on the magnetic brush is increased at the critical points with the simplest means and in such a manner that a high quality image is produced on the intermediate image carrier 1.

I claim:

1. Developing apparatus for an electrophotographic copier which includes an intermediate image carrier;

a developer drum comprising a rotatably mounted magnetic arrangement and a nonmagnetic electrically conductive hollow cylinder fixedly surrounding said magnetic arrangement; and means for applying at a dosaging gap a magnetic brush of magnetic developer particles onto the electrically conductive surface of said hollow cylinder, the transfer of said developer particles from the magnetic brush onto said intermediate image carrier being effected by the electric field originating from the latent image, wherein said nonmagnetic hollow cylinder has a reduced wall thickness adjacent said intermediate image carrier, said reduced wall thickness being formed of a flattened portion at the outer circumference of the hollow cylinder adjacent said intermediate image carrier.

2. Apparatus according to claim 1, wherein said flattened portion has a curvature whose center lies on the normal through the axis of rotation of the magnetic arrangement and on the side of the circumferential face of the hollow cylinder facing the flattened portion.

3. Apparatus according to claim 1 or 2, wherein said hollow cylinder is provided with a further flattened portion along its underside.

4. Apparatus according to claim 1 or 2, wherein said hollow cylinder is provided with a further flattened portion adjacent said dosaging gap.

* * * * *